US006076806A

United States Patent [19]

Zemla

[11] Patent Number: 6,076,806

[45] Date of Patent: Jun. 20, 2000

[54] POOL COVER TOP TRACK PULLEY END CAP

[76] Inventor: Noel Zemla, 3941 Poplar St., Chino Hills, Calif. 91709-2655

[21] Appl. No.: 09/211,312

[22] Filed: Dec. 14, 1998

Related U.S. Application Data

[60] Provisional application No. 60/070,354, Jan. 2, 1998.

[51] Int. Cl.[7] ..... B66D 3/04

[52] U.S. Cl. ..... 254/390; 254/411

[58] Field of Search ..... 254/390, 411, 254/413, 415

[56] References Cited

U.S. PATENT DOCUMENTS

| | | | |
|---|---|---|---|
| 194,326 | 8/1877 | Bischoff | 254/390 |
| 1,535,791 | 4/1925 | Raeburn | 254/390 |
| 5,154,401 | 10/1992 | Schramm et al. | 254/390 X |
| 5,368,281 | 11/1994 | Skyba | 254/411 X |

FOREIGN PATENT DOCUMENTS

| | | | |
|---|---|---|---|
| 573809 | 3/1933 | Germany | 254/390 |

OTHER PUBLICATIONS

Poolsaver, Inc., Drawing (undated) of previous endcap assembly.

*Primary Examiner*—Donald F. Walsh
*Assistant Examiner*—Emmanuel M. Marcelo
*Attorney, Agent, or Firm*—Christie, Parker & Hale, LLP

[57] ABSTRACT

An end cap assembly which has recessed areas in the base and cover which accept protruding spindles on the upper and lower surfaces of the pulley to align the pulley, provides easy access to the pulley without removal of the track by attaching the base portion of the assembly but not the cover portion to the track, and is Constructed of higher strength and more durable materials than previous end cap assemblies available, resisting cracking even in extreme environments.

16 Claims, 1 Drawing Sheet

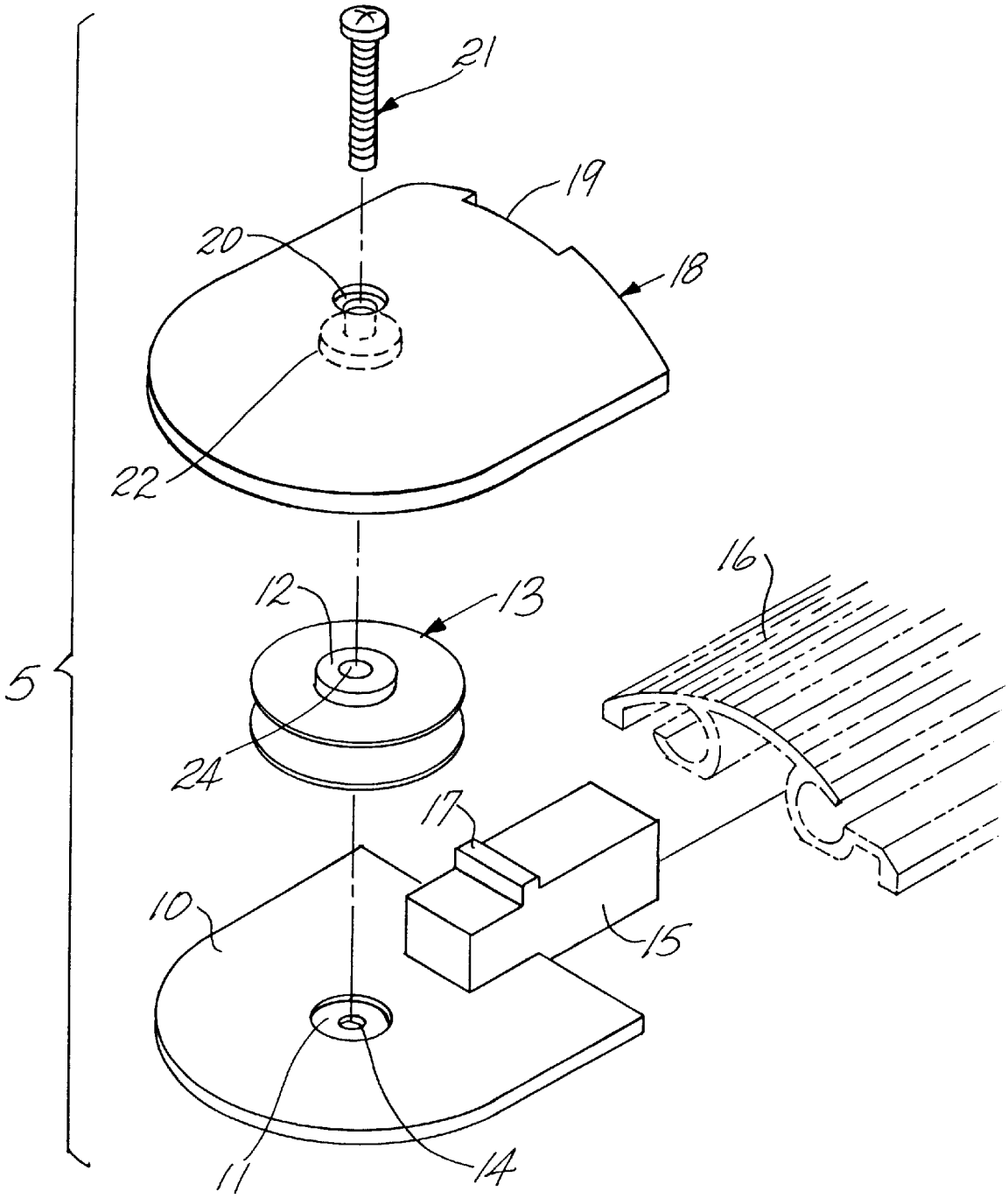
21
19
20
18
22
16
12
13
5
24
17
10
15
11
14

POOL COVER TOP TRACK PULLEY END CAP

CROSS REFERENCE TO RELATED APPLICATIONS

This application claims priority from U.S. Provisional application Ser. No. 60/070,354 filed Jan. 2, 1998.

FIELD OF THE INVENTION

This invention is related to equipment and devices for covering pools and more specifically to an improved end cap assembly.

BACKGROUND OF THE INVENTION

Covering devices for pools generally utilize a pulley means. Parallel tracks are attached to the deck surface on either side of the pool. A pulley is placed at the end of each track to receive a cable or other means for moving a pool cover. The pulley is generally protected by a housing.

Typically, these pulley housings are plastic end cap assemblies which fit: on the end of the track and cover the pulley. This end cap assembly is outdoors and exposed to the elements. Extended exposure to sunlight generally makes the plastic housing brittle, and likely to crack. Exposure to cold weather and snow has a similar effect on plastic housings. Thus the life of a plastic housing is greatly limited due to exposure to weather conditions.

Periodically, the end cap assembly must be removed. This may be to perform routine maintenance, such as lubricating the pulley or removing debris from around the pulley, or to replace a pulley that has worn out. Typical plastic end cap assemblies are generally composed of several components. From the top, there is the plastic cover over the pulley with a tab that extends under and mates with the track. Next is the pulley itself. Underneath the pulley is a plastic base. The pulley rests directly on the plastic base. Although the pulley may rotate, free rotation is inhibited by the lower surface of the pulley binding on the plastic base. A screw extends from the top of the assembly down through the cover, pulley and base and into a lock nut at the bottom of the assembly. Thus to access the pulley, the track has to be partially detached from the deck En order to lift up the track and remove the plastic cover whose tab extended underneath the track. In addition to the screw in the cover of the plastic end car Assembly, one would also have to remove several of the screws holding down the track, then lift the track and remove :he assembly from beneath the track. Only then would one have (complete access to the pulley, and be able to remove debris from, lubricate or replace the pulley. Considering the cover incorporated the tab which attached the assembly to the track, the entire assembly needed to be unassembled from the track to access the pulley.

Having performed the maintenance or replaced the pulley, re-assembly of the end cap assembly may also be difficult. The lock nut underneath the housing is not an integrated cart of the existing end cap assembly, and re-assembly of the end cap assembly is difficult as the nut is not in a fixed position.

Accordingly, there is a need for an improvement in the pulley end cap assembly, to (create a more durable assembly, and to facilitate easier access to the pulley through a more efficient housing means.

SUMMARY OF THE INVENTION

The present invention provides an improved end cam assembly. Access to the pulley is accomplished with the removal of a single screw. Instead of linking the cover portion of the assembly to the track, the base portion of the end cap assembly is linked to the track instead. In the current invention, the base portion of the assembly is anchored solidly to the track, while the cover section of the assembly may be opened and the pulley accessed without disturbing the track. This allows both easier access to the pulley, and more permanent installation of the track. The base portion of the assembly now provides a recessed area to seat the pulley, allowing the pulley to rotate freely without binding. The lock nut underneath the base portion may also be integrated into the base. In the preferred embodiment, the cover and base of the end cap assembly are constructed of aluminum to provide better strength and durability, and resistance to heat or cold; however, any other high strength, durable material that does not become brittle after exposure to extreme temperatures or sunlight could also be used.

BRIEF DESCRIPTION OF THE DRAWINGS

The FIGURE is an exploded view of one embodiment in accordance with the present invention.

DETAILED DESCRIPTION

The end cap assembly 5 of the present invention is shown in the FIGURE. The base portion 10 of the end cap assembly 5 is a flat base 10, with a circular recessed area 11 to receive a protruding spindle surface 12 extending from a lower surface of a pulley 13. The FIGURE shows spindle 12 extending from an upper surface of pulley 13, however it is understood that pulley 13 has spindles extending from both the upper and lower surfaces. There is a hole 14 in the base 10 concentric to the recessed area 11. In one embodiment, this hole is threaded to receive a screw. The base 10 also contains a rectangular tab 15, protruding from an end of the base 10, so that tab 15 may mate with an end of a track member 16, shown in phantom. The tab 15 is of such height, width and depth that it may be received lengthwise by the track member 16, producing a tight, friction fit. The tab contains a small protrusion 17 forming a stop along the width of its upper surface, located a distance from each end of the tab 15, such that the extent the tab 15 may be Inserted Into an open end of a track member 16 is thereby limited.

The pulley 13 is a circular, spool shaped wheel, having an upper and lower surface with a small, circular raised spindle protrusion 12 on both the upper and lower surfaces. The spindle protrusion 12 on the lower surface of the pulley 13 is received by the recessed area 11 of the base portion, allowing the pulley to spin freely. The pulley has an axial hole 24 extending through the spindles, which is aligned with the hole 14 in the base. The pulley is preferably made from stainless steel.

A cover 18 of substantially the same shape as the base, having an upper and lower surface, rests flush on the base 10 and tab 15. The lower surface of the cover 18 has a circular recess 22 to receive the spindle protrusion 12 of the pulley 13, allowing the pulley 13 to spin freely. The upper surface of the cover has a countersunk hole 20, axially aligned with the circular recess 22 to receive an attachment means 21 attaching the cover 18 to the base 10 thorough the pulley 13. This hole 20 is aligned axially with the pulley 13 and with the hole 14 in the base. The cover 18 has a notch 19 cut in the shape of the raised stop 17 on the tab 15. The notch 19 fully engages the stop 17, making the end of the cover 18 flush with the end of the track 16.

The attachment means 21 extends through the hole 20 in the cover 18, through the axial hole 24 in the pulley 13, and into the hole 14 in the base 10.

In the preferred embodiment, the base and cover are constructed of aluminum. Other materials that provide strength and durability, and do not become brittle when exposed to heat, cold or sunlight, could also be used.

Thus, a more durable end cap assembly is disclosed which utilizes a more efficient design to provide access to the pulley and eliminate the need to detach a portion of the track. While embodiments and applications of this invention have been shown and described, it is apparent to those skilled in the art that many more modifications are possible without departing from the inventive concepts herein. It is, therefore, to be understood that within the scope of the appended claims, this invention may be practiced otherwise than as specifically described.

What is claimed is:

1. A pulley end cap assembly for a swimming pool cover comprising:

a pulley, having upper and lower surfaces, with raised circular protrusions, concentric to the upper and lower surfaces, on both the upper and lower surfaces;

a rigid, durable base which supports and provides means for aligning the pulley, the base having a tab for connection with a track;

a rigid, durable cover which attaches to the base, enclosing the pulley and having means for aligning the pulley;

a means for attaching the base and the cover which rotatably attaches the pulley therebetween.

2. An assembly as in claim 1 wherein the cover has a circular recess which receives the raised circular protrusion of the pulley.

3. An assembly as in claim 1 wherein the base has a circular recess which receives the raised circular protrusion of the pulley.

4. An assembly as in claim 1 wherein the attachment means is a threaded screw.

5. An assembly as in claim 4 further comprising a threaded receptacle within the base for receiving the attachment means.

6. An assembly as in claim 1 wherein the means to attach to a track is a tab on the base that slides under a track, with a raised stop on the tab to limit the depth of connection.

7. An assembly as in claim 6 wherein the cover has a notch to receive the raised stop on the tab.

8. An assembly as in claim 1 wherein the assembly is constructed of a high strength material resistant to the elements.

9. A pulley end cap assembly for a swimming pool cover track comprising:

a base having a tab on the base that engages with the track for attaching the base to the track;

a pulley positioned on the base;

a cover removably attached to the base to rotatably maintain the pulley within the assembly; and a threaded screw, extending through the cover and into the base.

10. An assembly as in claim 9 therein the cover has a circular recess which receives the raised circular protrusion of the pulley.

11. An assembly as in claim 9 wherein the base has a circular recess which receives the Raised circular protrusion of the pulley.

12. An assembly as in claim 9 further comprising a threaded receptacle within the base for receiving the screw means.

13. An assembly as in claim 12 wherein the tab on the base that slides under the track, has a raised stop on the tab to limit the depth of connection.

14. An assembly as in claim 13 wherein the cover has a notch to receive the raised stop oh the tab.

15. An assembly as in claim 9 wherein the assembly is constructed of a high strength material resistant to the elements.

16. A pulley end cap assembly for a swimming pool cover comprising:

a pulley, having upper and lower surfaces, with raised circular protrusions, concentric to the upper and lower surfaces, on both the upper and lower surfaces;

a rigid, durable base, having a circular recess which receives the raised circular protrusion of the lower surface of the pulley, the base supporting and aligning the pulley, and having a tab which slides under a track for engagement therewith, with a raised stop on the tab to limit the depth of engagement with the track, and having a threaded receptacle within the base;

a rigid, durable cover, having a circular recess which receives the raised circular protrusion of the upper surface of the pulley, the cover attaching to the base, enclosing and further aligning the pulley; and a threaded rod for attaching the base and the cover which rotatably attaches the pulley therebetween wherein the rod is received by the threaded receptacle within the base.

* * * * *

UNITED STATES PATENT AND TRADEMARK OFFICE

CERTIFICATE OF CORRECTION

PATENT NO. : 6,076,806
DATED : June 20, 2000
INVENTOR(S) : Noel Zemla

It is certified that error appears in the above-identified patent and that said Letters Patent is hereby corrected as shown below:

Column 4,
Line 3, after "on the base" insert -- having upper and lower surfaces, with raised circular protrusions, concentric to the upper and lower surfaces, on both the upper and lower surfaces --.
Line 9, replace "therein" with -- wherein --.
Line 13, replace "the Raised circular"with -- the raised circular --.
Lines 16-17, replace "screw means." with -- screw. --.
Line 23, replace "stop oh" with -- stop on --.

Signed and Sealed this

Fourth Day of December, 2001

*Attest:*

Nicholas P. Godici

*Attesting Officer*

NICHOLAS P. GODICI
*Acting Director of the United States Patent and Trademark Office*